US007598934B2

(12) United States Patent
Moon

(10) Patent No.: US 7,598,934 B2
(45) Date of Patent: Oct. 6, 2009

(54) PLASMA DISPLAY APPARATUS AND DRIVING METHOD THEREOF

(75) Inventor: Seonghak Moon, Seoul (KR)

(73) Assignee: LG Electronics Inc., Seoul (KR)

( * ) Notice: Subject to any disclaimer, the term of this patent is extended or adjusted under 35 U.S.C. 154(b) by 696 days.

(21) Appl. No.: 11/269,713

(22) Filed: Nov. 9, 2005

(65) Prior Publication Data

US 2006/0097964 A1 May 11, 2006

(30) Foreign Application Priority Data

Nov. 10, 2004 (KR) ..... 10-2004-0091641

(51) Int. Cl.
*G09G 3/28* (2006.01)
*G09G 3/10* (2006.01)

(52) U.S. Cl. ..... 345/68; 345/60; 315/169.4

(58) Field of Classification Search ..... 345/55–100, 345/204–214; 315/169.4
See application file for complete search history.

(56) References Cited

U.S. PATENT DOCUMENTS 6,211,854 B1 * 4/2001 Fujiyoshi ..... 345/10
6,417,824 B1 7/2002 Tokunaga et al.
7,133,027 B2 * 11/2006 Kimura ..... 345/163
7,142,175 B2 * 11/2006 Kang ..... 345/63
2002/0054001 A1 * 5/2002 Awamoto ..... 345/60
2003/0169217 A1 * 9/2003 Kang et al. ..... 345/63
2004/0061709 A1 * 4/2004 Park et al. ..... 345/690
2005/0062688 A1 * 3/2005 Lee et al. ..... 345/60
2006/0050022 A1 * 3/2006 Kang ..... 345/60
2006/0066515 A1 * 3/2006 Han ..... 345/60

FOREIGN PATENT DOCUMENTS

EP 1 650 735 A 4/2006
JP 06-289811 10/1994
JP 2004-302115 10/2004

* cited by examiner

*Primary Examiner*—David L Lewis
(74) *Attorney, Agent, or Firm*—McKenna Long & Aldridge LLP

(57) ABSTRACT

The present invention relates to a plasma display apparatus and driving method thereof. In an embodiment of the present invention, a scan bias voltage that is controlled according to a mapped sub-field, a data load or an APL of each sub-field is supplied. In an embodiment of the present invention, a scan bias voltage is changed depending on a sub-field, an APL or a data load. Therefore, address margin can be improved, a stabilized operation can be provided, and an erroneous discharge and/or miswriting can be prevented.

14 Claims, 5 Drawing Sheets

PLASMA DISPLAY APPARATUS AND DRIVING METHOD THEREOF

CROSS-REFERENCES TO RELATED APPLICATIONS

This Nonprovisional application claims priority under 35 U.S.C. § 119(a) on Patent Application No. 2004-91641 filed in Korea on Nov. 10, 2004 the entire contents of which are hereby incorporated by reference.

BACKGROUND OF THE INVENTION

1. Field of the Invention

The present invention relates to a plasma display apparatus and driving method thereof.

2. Background of the Related Art

In general, a plasma display panel comprises a front substrate and a rear substrate formed of soda-lime glass. Barrier ribs formed between the front substrate and the rear substrate partition discharge cells. An inert gas injected into the discharge cells, such as helium-xeon (He—Xe) or helium-neon (He—Ne), is excited with a high frequency voltage to generate a discharge. When the discharge is generated, vacuum ultraviolet rays are generated. Vacuum ultraviolet rays excite phosphors formed between the barrier ribs, thus displaying images.

FIG. 1 is a perspective view schematically showing the construction of a plasma display panel in the related art. As shown in FIG. 1, the plasma display panel in the related art comprises a front panel 10 and a rear panel 11. The front panel comprises a front glass substrate 100 and the rear panel comprises a rear glass substrate 110. The front panel 10 and the rear panel 11 are parallel to each other with a predetermined distance therebetween.

A sustain electrode pair 101, 102 for sustaining the emission of a cell through mutual discharge is formed on the front glass substrate 100. The sustain electrode pair 101, 192 comprises a scan electrode 101 and a sustain electrode 102. The scan electrode 101 comprises a transparent electrode 101*a* formed of a transparent ITO material and a bus electrode 101*b* formed of a metal material. The sustain electrode 102 comprises a transparent electrode 102*a* formed of a transparent ITO material and a bus electrode 102*b* formed of a metal material.

The scan electrode 101 receives a scan signal for scanning the panel and a sustain signal for sustaining a discharge. The sustain electrode 102 mainly receives a sustain signal. A dielectric layer 103 is formed on the sustain electrode pair 101, 102, and it functions to limit the discharge current and provides insulation between the electrode pairs. A protection layer 104 is formed on a top surface of the dielectric layer 103 and is formed of magnesium oxide (MgO) so as to facilitate a discharge condition.

Address electrodes 112 crossing the sustain electrode pair 101, 102 are disposed on the rear glass substrate 11. A dielectric layer 114 is formed on the address electrodes 112 and functions to provide insulation between the address electrodes 112. Barrier ribs 111 are formed on the dielectric layer 114 and partition discharge cells. R, G and B phosphor layers 113 are coated between the barrier ribs 111 and the barrier ribs 111 and radiate a visible ray for displaying images.

The front glass substrate 100 and the rear glass substrate 110 are adhered together by a sealing material. Inert gases, such as helium (He), neon (Ne) and xeon (Xe), are injected into the plasma display panel after an exhaust process is performed.

A method of representing gray levels of the plasma display panel constructed above will now be described with reference to FIG. 2.

FIG. 2 is a view for illustrating a method of implementing image gray levels of the plasma display panel in the related art. As shown in FIG. 2, in order to represent image gray levels of the plasma display panel in the related art, one frame is divided into several sub-fields having a different number of emissions. Each of the sub-fields is divided into a reset period for initializing all of the cells, an address period for selecting a cell to be discharged, and a sustain period for implementing gray levels depending on the number of discharges.

For example, if it is sought to display images with 256 gray levels, a frame period (16.67 ms) corresponding to 1/60 seconds is divided into eight sub-fields (SF1 to SF8) as shown in FIG. 2. Each of the eight sub-fields (SF1 to SF8) is again divided into a reset period, an address period and a sustain period.

The reset period and the address period of each sub-field are the same every sub-field. An address discharge for selecting a cell to be discharged is generated because of a voltage difference between the address electrodes and the scan electrodes (i.e., transparent electrodes). The sustain period is increased in the ratio of $2^n$ (where n=0,1,2,3,4,5,6,7) in each sub-field. Since the sustain period is varied every sub-field as described above, gray levels of an image are represented by controlling the sustain period of each sub-field, i.e., a sustain discharge number.

FIG. 3 shows a driving waveform of the plasma display panel in the related art.

In the driving waveform of the plasma display panel in the related art, in the reset period, a ramp-up pulse (Ramp-up) and a ramp-down pulse (Ramp-down) are applied to the scan electrode Y. The ramp-up pulse (Ramp-up) has a waveform whose voltage rises from a sustain voltage (Vs) at a predetermined tilt. The ramp-up pulse (Ramp-up) causes a dark discharge to be generated in all of the cells of the screen. This dark discharge causes positive wall charges to be accumulated on the address electrode X and the sustain electrode Z and negative wall charges to be accumulated on the scan electrode Y.

After the ramp-up pulse (Ramp-up) is applied to the scan electrode Y, the ramp-down pulse (Ramp-down) is applied to the scan electrode Y. The ramp-down pulse (Ramp-down) has a waveform whose voltage falls from the sustain voltage (Vs) at a predetermined tilt. The ramp-down pulse (Ramp-down) causes some of wall charges, which are excessively formed within the cells, to be erased. The ramp-down pulse (Ramp-down) causes wall charges of the degree in which an address discharge can be stably generated to uniformly remain within the cells.

In the address period, while a write scan voltage (−Vyw) is applied to the scan electrode Y, a data pulse is applied to the address electrode X, so that an address discharge is generated. Furthermore, a scan voltage (Vsc) is applied to the remaining scan electrodes other than the scan electrode to which the write scan voltage (−Vyw) is applied and scan electrodes other than scan electrodes on which scanning is performed.

If the address period is finished as described above, sustain pulses are alternately applied to the scan electrode Y and the sustain electrode Z, so that, a sustain discharge is generated. In the driving waveform of the plasma display apparatus in the related art, the scan voltage (Vsc) applied to the scan electrode Y in the address period is the same in all of the sub-fields and is also the same regardless of variation in an Average Picture Level (APL) or a data load. Because the scan voltage (Vsc) is the same without regard to variation in sub-fields or a data load as described above, address margin is changed. Therefore, a problem arises because miswriting or an erroneous discharge is generated.

SUMMARY OF THE INVENTION

Accordingly, the present invention has been made in view of the above problems occurring in the prior art, and it is an object of the present invention to provide a plasma display apparatus and driving method thereof, in which a voltage applied to the scan electrodes in the address period can be varied depending on a sub-field, an APL or a data load.

To achieve the above object, a plasma display apparatus according to an aspect of the present invention comprises a timing controller that calculates a gray level from an input video signal, a sub-field detector that performs a sub-field mapping on the gray level calculated by the timing controller and outputs a voltage-controlled signal depending on the mapped sub-field, a voltage converter that receives the voltage-controlled signal from the sub-field detector and controls a scan bias voltage depending on variation in the mapped sub-field, an electrode driver that supplies the scan bias voltage, which is outputted from the voltage converter according to timing control of the timing controller in an address period and a plasma display panel comprising a scan electrode to which the scan bias voltage output from the voltage changer is applied.

A driving method of a plasma display apparatus comprising scan electrodes according to another aspect of the present invention comprises the steps of calculating a gray level from an input video signal, performing sub-field mapping on the calculated gray level and outputting a voltage-controlled signal depending on the mapped sub-field, controlling a scan bias voltage depending on a change of the mapped sub-field according to the voltage-controlled signal, and supplying the controlled scan bias voltage to the scan electrodes.

In accordance with a plasma display apparatus and driving method thereof of the present invention, a scan bias voltage is changed depending on a sub-field, an APL or a data load. Therefore, address margin can be improved, a stabilized operation can be provided, and an erroneous discharge and/or miswriting can be prevented.

BRIEF DESCRIPTION OF THE DRAWINGS

Further objects and advantages of the invention can be more fully understood from the following detailed description taken in conjunction with the accompanying drawings in which.

DETAILED DESCRIPTION OF THE PREFERRED EMBODIMENT

Figure 1:
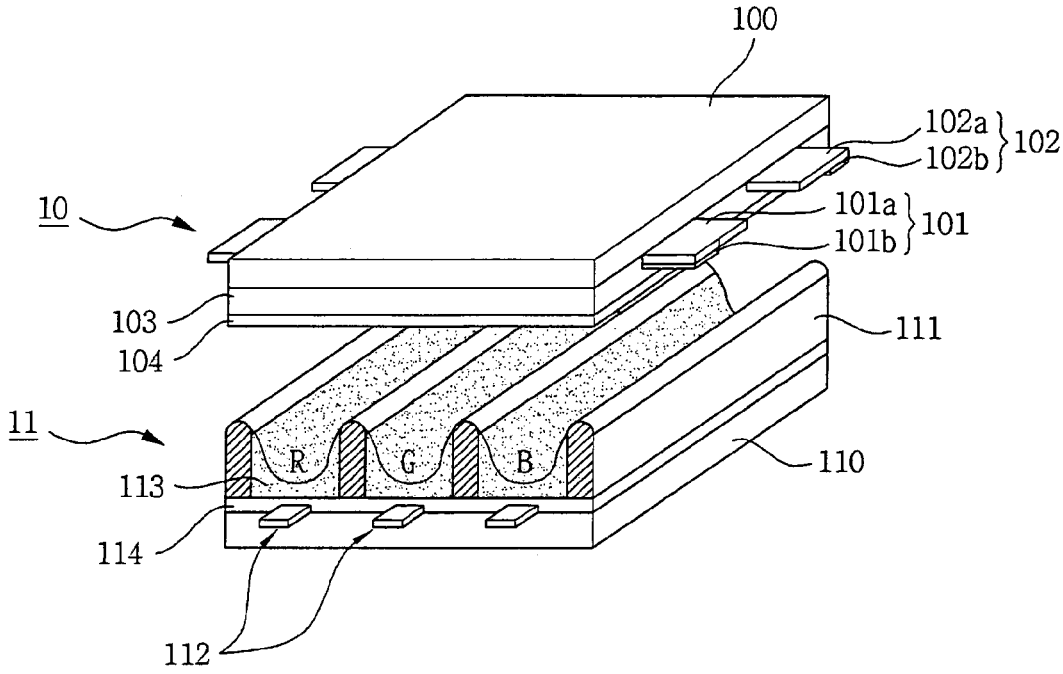
FIG. 1 is a perspective view showing the construction of a general plasma display panel.
Figure 2:
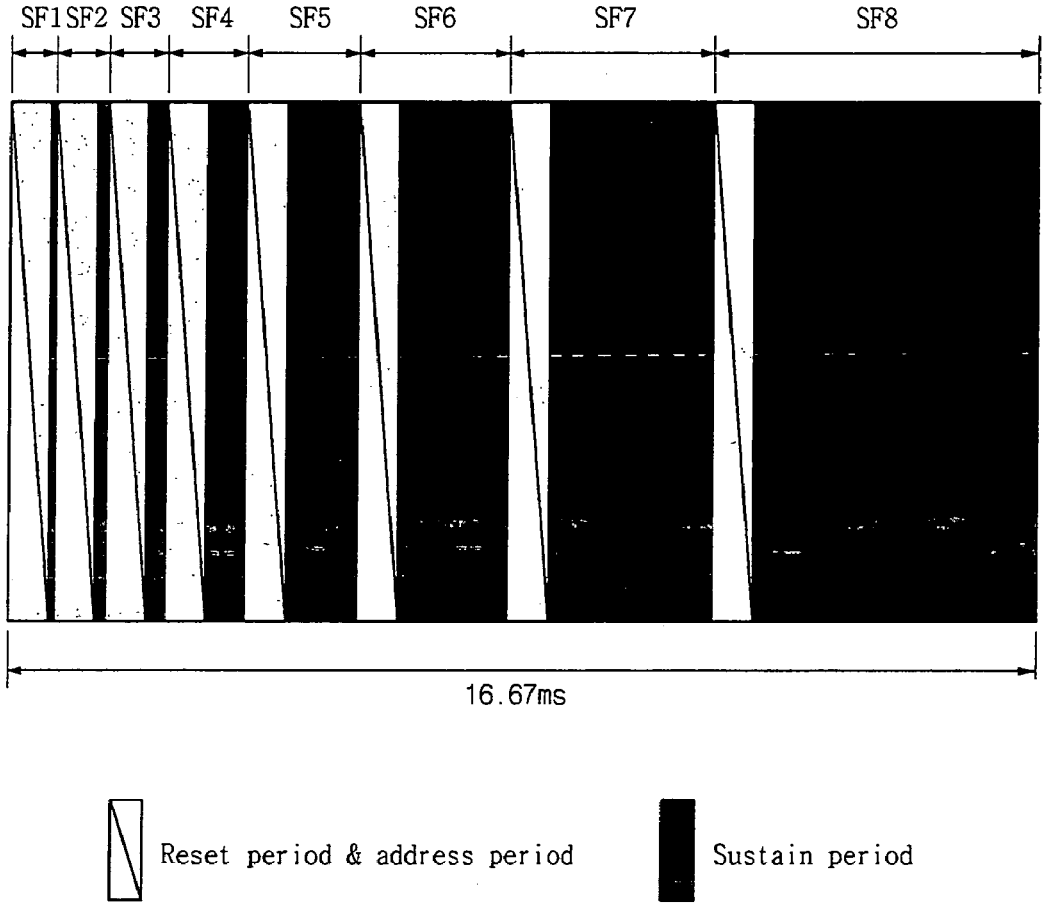
FIG. 2 is a view for illustrating a method of representing images gray levels of a plasma display panel in the related art.
Figure 3:
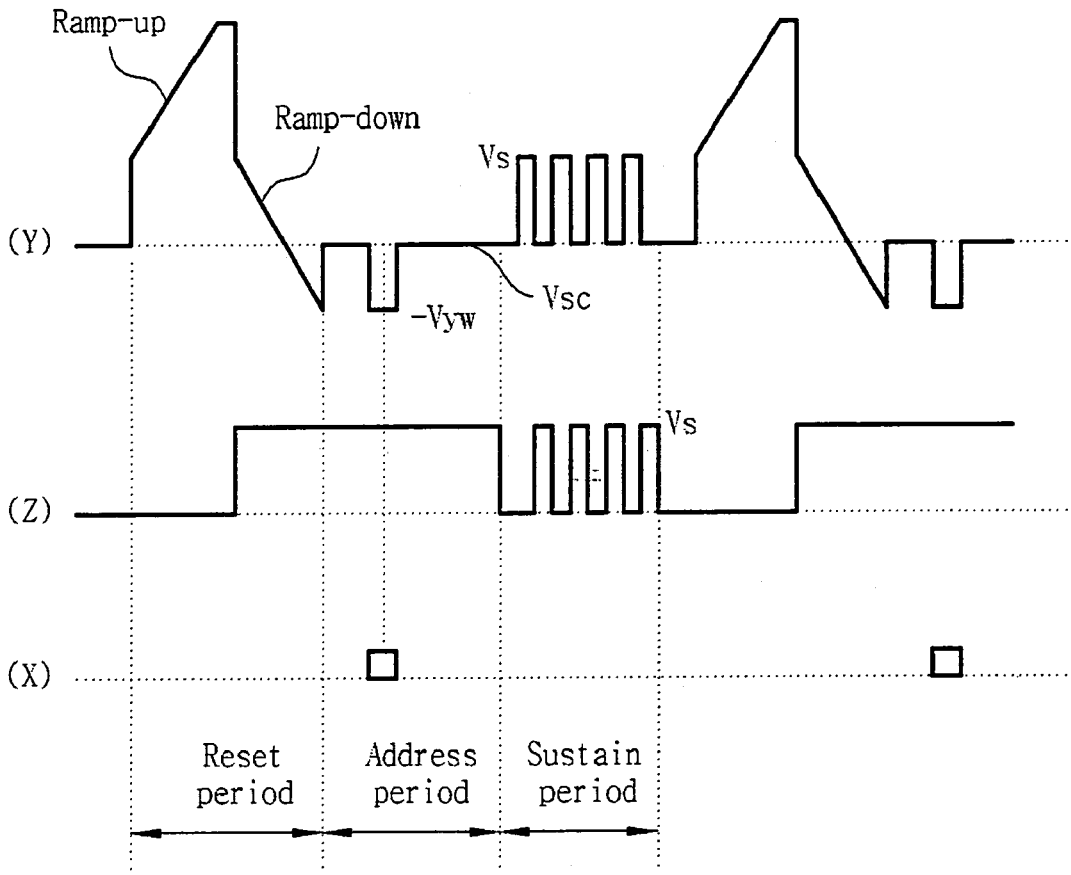
FIG. 3 shows a driving waveform of the plasma display panel in the related art.

A plasma display apparatus according to an aspect of the present invention comprises a timing controller that calculates a gray level from an input video signal, a sub-field detector that performs a sub-field mapping on the gray level calculated by the timing controller and outputs a voltage-controlled signal depending on the mapped sub-field, a voltage converter that receives the voltage-controlled signal from the sub-field detector and controls a scan bias voltage depending on variation in the mapped sub-field, an electrode driver that supplies the scan bias voltage, which is outputted from the voltage converter according to timing control of the timing controller in an address period and a plasma display panel comprising a scan electrode to which the scan bias voltage output from the voltage changer is applied.

The sub-field detector may calculate at least one of an APL and a data load on the mapped sub-field and outputs the voltage-controlled signal according to the calculation result. The voltage converter may output the scan bias voltage that is varied depending on at least one of the APL and the data load of the sub-field.

The voltage converter may comprises a DC/DC converter.

The voltage converter may supply different scan bias voltages in each mapped sub-field according to the voltage-controlled signal.

The voltage converter may control a scan bias voltage in at least one of all of the sub-fields to be different from scan bias voltages in the remaining sub-fields according to the voltage-controlled signal.

The voltage converter may increase a magnitude of a negative scan bias voltage as the address margin of the sub-fields decreases.

The voltage converter may decrease a magnitude of a negative scan bias voltage as the address margin of the sub-fields increases.

The voltage converter may output a writing scan pulse in an address period.

A driving method of a plasma display apparatus comprising scan electrodes according to another aspect of the present invention comprises the steps of calculating a gray level from an input video signal, performing sub-field mapping on the calculated gray level and outputting a voltage-controlled signal depending on the mapped sub-field, controlling a scan bias voltage depending on a change of the mapped sub-field according to the voltage-controlled signal, and supplying the controlled scan bias voltage to the scan-electrodes.

At least one of an APL and a data load on the mapped sub-field may be calculated and the voltage-controlled signal according to the calculation result may be output. The scan bias voltage that is controlled according to at least one of the APL and the data load of the sub-field may be output.

Different scan bias voltages may be output in each mapped sub-field according to the voltage-controlled signal.

A scan bias voltage in at least one of all of the sub-fields may be set to be different from scan bias voltages in the remaining sub-fields according to the voltage-controlled signal.

A magnitude of a negative scan bias voltage is set to increase as the address margin of the sub-fields decreases.

A magnitude of a negative scan bias voltage is set to decrease as the address margin of the sub-fields increases.

In accordance with a plasma display apparatus and driving method thereof of the present invention, a scan bias voltage is changed depending on a sub-field, an APL or a data load. Therefore, address margin can be improved, a stabilized operation can be provided, and an erroneous discharge and/or miswriting-can be prevented.

The present invention will now be described in detail in connection with preferred embodiments with reference to the accompanying drawings.

Figure 4:
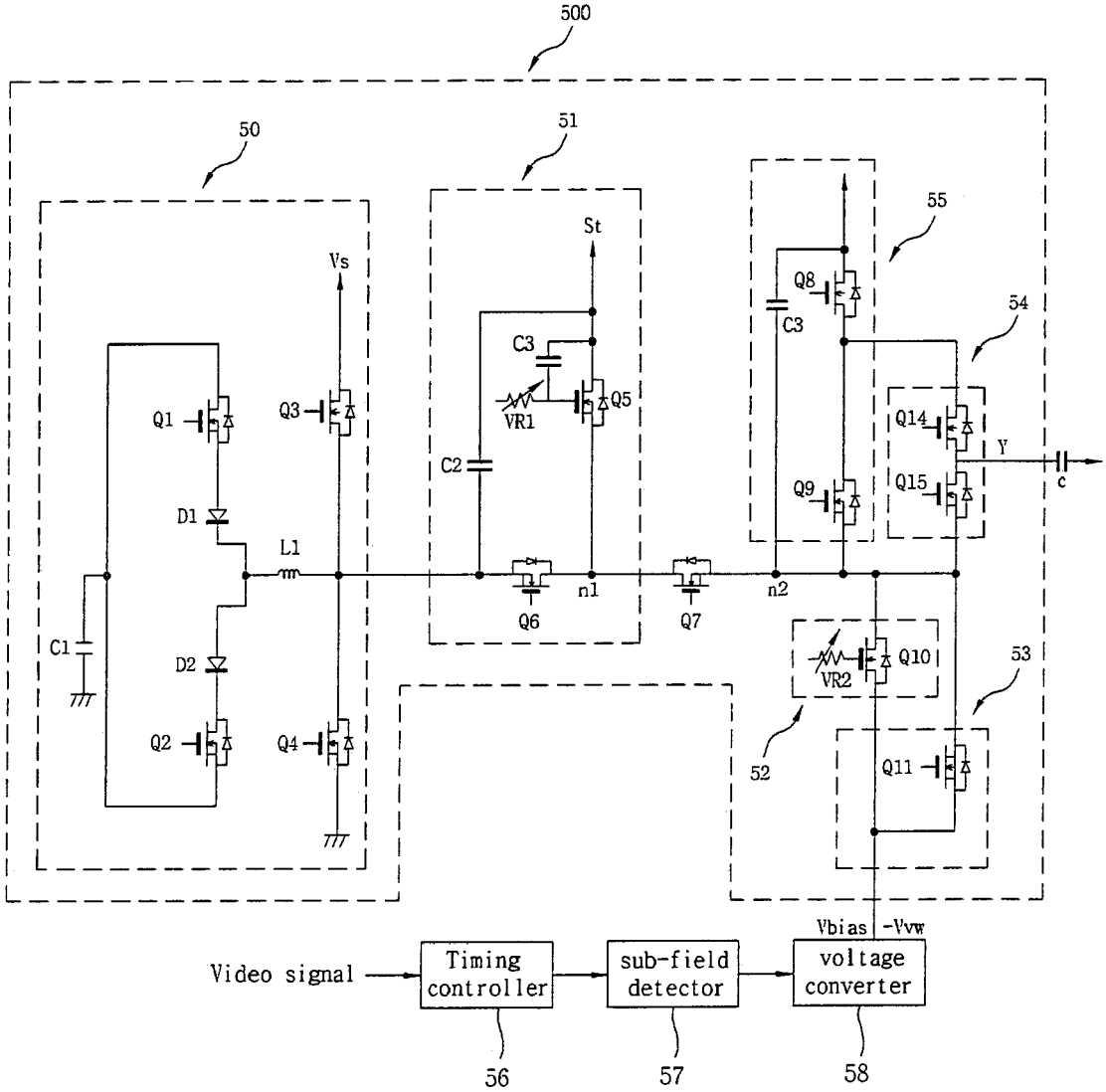
FIG. 4 shows the construction of a plasma display apparatus according to an embodiment of the present invention.

FIG. 4 shows the construction of a plasma display apparatus according to an embodiment of the present invention. As shown in FIG. 4, the plasma display apparatus according to an embodiment of the present invention comprises a plasma display panel C, a timing controller 56, a sub-field detector 57, a voltage converter 58 and an electrode driver 500.

<Plasma Display Panel>

The plasma display panel C comprises scan electrodes to which a scan writing voltage (−Vyw) and a scan bias voltage (Vbias) are applied.

<Timing Controller>

The timing controller 56 calculates a gray level corresponding to each cell from an input video signal.

<Sub-field Detector>

The sub-field detector 57 performs a sub-field mapping on the gray level of the cell, which is calculated by the timing controller 56, and outputs a- voltage-controlled signal depending on the mapped sub-field. Furthermore, the sub-field detector 57 can perform sub-field mapping on the gray level of the cell, which is calculated by the timing controller 56, calculate an APL or a data load for each mapped sub-field and outputs a voltage-controlled signal.

<Voltage Converter>

The voltage converter 58 supplies the write scan voltage (−Vyw) when the scan electrodes are scanned, receives the voltage-controlled signal from the sub-field detector 57 and outputs the scan bias voltage (Vbias), which is varied depending on one of variation in sub-field, an APL of each sub-field and a data load of each sub-field. The voltage converter 58 comprises a DC/DC converter. The voltage converter 58 receives the voltage-controlled signal and outputs the scan bias voltage (Vbias) that is varied by changing the duty ratio.

<Electrode Driver>

The electrode driver 500 applies the write scan voltage (−Vyw), which is outputted from the voltage converter 58, to the scan electrodes on which scanning is performed according to timing control of the timing controller 56. Furthermore, the electrode driver 500 applies the scan bias voltage (Vbias), which is outputted from the voltage converter 58, to the remaining scan electrodes other than a scan electrode on which scanning is performed in the address period according to timing control of the timing controller 56.

Figure 5:
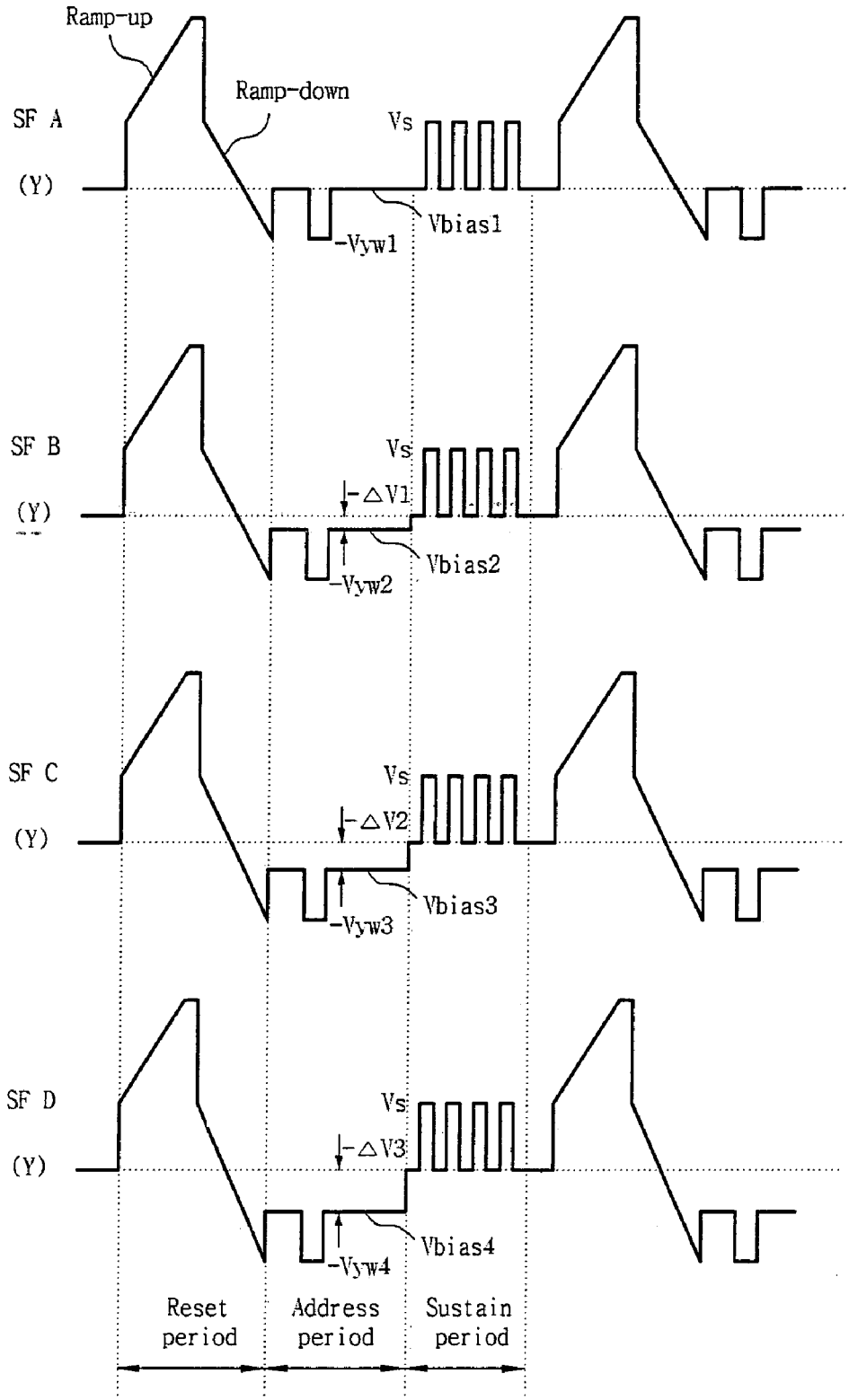
FIG. 5 is a view for illustrating a driving method of the plasma display apparatus according to an embodiment of the present invention.

The operation of the plasma display apparatus according to an embodiment of the present invention will be described below with reference to FIGS. 4 and 5. FIG. 5 is a view for illustrating a driving method of the plasma display apparatus according to an embodiment of the present invention.

During a reset period of FIG. 4, a set-up switch Q5 and a seventh switch Q7 are turned on. A sustain voltage (Vs) is applied from a sustainer 50. The sustain voltage (Vs) is applied to scan electrodes Y via a body diode of the sixth switch Q6, a seventh switch Q7 and a drive IC 54.

Since the sustain voltage (Vs) is applied to a negative terminal of a second capacitor C2, a voltage level of the negative terminal of the second capacitor C2 becomes the sustain voltage (Vs), and a voltage level of a positive terminal of the second capacitor C2 becomes the sum (Vs+Vst) of the sustain voltage (Vs) and a set-up voltage (Vst).

The set-up switch Q5 of a ramp-up pulse supplier 51 operates in an active region and applies a ramp-up pulse (Ramp-up) whose voltage rises from the sustain voltage (Vs) up to the sum (Vs+Vst) of the sustain voltage (Vs) and a set-up voltage (Vst) to a first node point n1. A first variable resistor VR1 decides the tilt of the ramp-up pulse (Ramp-up). The ramp-up pulse (Ramp-up) supplied to the first node point n1 is supplied to the scan electrodes Y via the seventh switch Q7 and the drive IC 54 connected to each scan electrode, so that a waveform of the ramp-up pulse (Ramp-up) as shown in FIG. 5 is formed.

After the ramp-up pulse (Ramp-up) is applied to the scan electrodes Y, the set-up switch Q5 is turned off. If the set-up switch Q5 is turned off, only the sustain voltage (Vs) applied to the sustainer 50 is applied to the first node point n1. Therefore, as shown in FIG. 5, a voltage of the scan electrodes Y abruptly drops to the sustain voltage (Vs).

Thereafter, the seventh switch Q7 is turned off and a set-down switch Q10 of a ramp-down pulse supplier 52 is turned on at the same time. The set-down switch Q10 operates in the active region and drops a voltage of a second node n2 from the sustain voltage (Vs) up to the write scan voltage (−Vyw) at a predetermined tilt. The voltage of the second node n2 is applied to the scan electrodes Y via the drive IC 54, so that a waveform of the ramp-down pulse (Ramp-down) as shown in FIG. 5 is formed. A second variable resistor VR2 decides the tilt of the ramp-down pulse (Ramp-down).

Meanwhile, the timing controller 56 calculates a gray level corresponding to each cell from the input video signal. The sub-field detector 57 performs sub-field mapping on the gray level of the cell, which is calculated by the timing controller 56, calculates an APL or a data load on each mapped sub-field and outputs a voltage-controlled signal.

The voltage converter 58 receives the voltage-controlled signal from the sub-field detector 57 and supplies the scan bias voltage (Vbias) that is controlled according to a sub-field. Furthermore, the voltage converter 58 applies the write scan voltage (−Vyw) when one scan electrode is scanned.

That is, the voltage converter 58 applies the write scan voltage (−Vyw) to a specific scan electrode via a tenth switch Q10 that is turned on when the specific scan electrode is scanned. Furthermore, the voltage converter 58 applies the scan bias voltage (Vbias) to scan electrodes other than the specific scan electrode via an eleventh switch Q11 that is turned on. At this time, a voltage that is finally applied to the scan electrodes other than the specific scan electrode is the sum of the scan voltage (Vsc) that is applied as an eighth switch Q8 is turned on and the scan bias voltage (Vbias) that is applied by the voltage converter 58.

The voltage converter 58 can differently apply scan bias voltages applied in each of all of the sub-fields and can differently supply scan bias voltages supplied in at least one of all of the sub-fields. Furthermore, the voltage converter 58 can change the write scan voltage (−Vyw) depending on the amount of change in the scan bias voltage (Vbias).

Through this process, the voltage changer 58 can supply the scan bias voltage (Vbias) differently every sub-field A (SFA), sub-field B (SFB), sub-field C (SFC) and sub-field D (SFD), as shown in FIG. 5. That is, in the case where the voltage changer 58 applies Vbias1 in the sub-field A (SFA), the voltage changer 58 applies Vbias2 (=Vbias1−ΔV1), Vbias3 (=Vbias1−ΔV2) and Vbias4 (=Vbias1−ΔV3) in the sub-field B (SFB), the sub-field C (SFC) and the sub-field D (SFD), respectively.

That is, in the case of a sub-field whose address margin decreases or wall charges are short due to an APL or a data load, the waveform of the sub-field D (SFD) shown in FIG. 5 is appropriate. If a magnitude of the negative scan bias voltage (Vbias4) increases after the reset pulse is applied, the address margin will increase.

Meanwhile, in the case of a sub-field whose address margin increases or wall charges are sufficient due to an APL or a data load, the waveform of the sub-field A (SFA) shown in FIG. 5 is appropriate. If the magnitude of the negative scan bias voltage (Vbias4) decreases after the reset pulse is applied, the address margin will decrease.

Therefore, miswriting or an erroneous discharge, which is incurred by different address margin, can be prevented.

Furthermore, the voltage changer 58 can supply −Vyw2 (=−Vyw1−ΔV1), −Vyw3 (=−Vyw1−ΔV2) and −Vyw4 (=−Vyw1−ΔV3) in the sub-field B (SFB), the sub-field C (SFC) and the sub-field D (SFD) in the case where it provides −Vyw1 in the sub-field A (SFA) by changing the write scan voltage (−Vyw) depending on the amount of change in the scan bias voltage (Vbias).

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A plasma display apparatus, comprising:

a timing controller that calculates a gray level from an input video signal;

a sub-field detector that performs a sub-field mapping on the gray level calculated by the timing controller and outputs a voltage-controlled signal depending on the mapped sub-field;

a voltage converter that receives the voltage-controlled signal from the sub-field detector and controls a scan bias voltage depending on variation in the mapped sub-field;

an electrode driver that supplies the scan bias voltage, which is outputted from the voltage converter according to timing control of the timing controller in an address period; and a plasma display panel comprising a scan electrode to which the scan bias voltage output from the voltage changer is applied.

2. The plasma display apparatus as claimed in claim 1, wherein the sub-field detector calculates at least one of an APL and a data load on the mapped sub-field and outputs the voltage-controlled signal according to the calculation result, and the voltage converter outputs the scan bias voltage that varies depending on at least one of the APL and the data load of the mapped sub-field.

3. The plasma display apparatus as claimed in claim 1, wherein the voltage converter comprises a DC/DC converter.

4. The plasma display apparatus as claimed in claim 1, wherein the voltage converter supplies different scan bias voltages in each mapped sub-field according to the voltage-controlled signal.

5. The plasma display apparatus as claimed in claim 1, wherein the voltage converter controls a scan bias voltage in at least one of all of the sub-fields to be different from the scan bias voltages in the remaining sub-fields according to the voltage-controlled signal.

6. The plasma display apparatus as claimed in claim 1, wherein the voltage converter increases a magnitude of a negative scan bias voltage as the address margin of the sub-fields decreases.

7. The plasma display apparatus as claimed in claim 1, wherein the voltage converter decreases a magnitude of a negative scan bias voltage as the address margin of the sub-fields increases.

8. The plasma display apparatus as claimed in claim 1, wherein the voltage converter outputs a writing scan pulse in an address period.

9. A driving method of a plasma display apparatus comprising scan electrodes, comprising the steps of:

calculating a gray level from an input video signal;

performing a sub-field mapping on the calculated gray level and outputting a voltage-controlled signal depending on the mapped sub-field;

controlling a scan bias voltage depending on a change of the mapped sub-field according to the voltage-controlled signal; and supplying the controlled scan bias voltage to the scan electrodes.

10. The driving method as claimed in claim 9, wherein at least one of an APL and a data load on the mapped sub-field is calculated and the voltage-controlled signal according to the calculation result is outputted, and the scan bias voltage that is controlled according to at least one of the APL and the data load of the sub-field is outputted.

11. The driving method as claimed in claim 9, wherein different scan bias voltages are output in each mapped sub-field according to the voltage-controlled signal.

12. The driving method as claimed in claim 9, wherein a scan bias voltage in at least one of all of the sub-fields is set to be different from scan bias voltages in the remaining sub-fields according to the voltage-controlled signal.

13. The driving method as claimed in claim 9, wherein a magnitude of a negative scan bias voltage is set to increase as the address margin of the sub-fields decreases.

14. The driving method as claimed in claim 9, wherein a magnitude of a negative scan bias voltage is set to decrease as the address margin of the sub-fields increases.

* * * * *